US007705262B2

(12) United States Patent
Allaire et al.

(10) Patent No.: US 7,705,262 B2
(45) Date of Patent: Apr. 27, 2010

(54) ALTERNATOR DISCONNECTOR CIRCUIT-BREAKER BY A SERVOMOTOR

(75) Inventors: Xavier Allaire, Chassieu (FR); Denis Frigiere, Decines (FR); Jean-Marc Willieme, La Mulatiere (FR)

(73) Assignee: Areva T&D SA, Paris la Defense Cedex (FR)

( * ) Notice: Subject to any disclaimer, the term of this patent is extended or adjusted under 35 U.S.C. 154(b) by 320 days.

(21) Appl. No.: 11/799,672

(22) Filed: May 1, 2007

(65) Prior Publication Data

US 2007/0262055 A1 Nov. 15, 2007

(30) Foreign Application Priority Data

May 12, 2006 (FR) ..... 06 51709

(51) Int. Cl.
*H01H 33/14* (2006.01)

(52) U.S. Cl. ..... 218/2; 218/7; 218/153

(58) Field of Classification Search ..... 218/1–14, 218/44, 58, 67–71, 78–80, 84, 119, 120, 218/140, 152–154
See application file for complete search history.

(56) References Cited

U.S. PATENT DOCUMENTS

| | | | | |
|---|---|---|---|---|
| 3,590,186 A | | 6/1971 | Brunner | |
| 3,943,314 A | * | 3/1976 | Frink | 218/60 |
| 5,905,242 A | * | 5/1999 | Bernard et al. | 218/16 |
| 6,751,078 B1 | * | 6/2004 | Munakata et al. | 361/58 |

FOREIGN PATENT DOCUMENTS

| | | |
|---|---|---|
| DE | 10016950 A1 | 10/2001 |
| EP | 0877405 A1 | 11/1998 |
| EP | 0878817 B1 | 11/1998 |
| EP | 1117114 A2 | 7/2001 |
| EP | 1310970 A1 | 5/2003 |
| WO | 97/08723 | 3/1997 |
| WO | 00/05735 | 2/2000 |

OTHER PUBLICATIONS

French Seach Report, FA 678057 and FR 0651709, 7pgs, (Jan. 16, 2007).

* cited by examiner

*Primary Examiner*—Renee Luebke
*Assistant Examiner*—Marina Fishman
(74) *Attorney, Agent, or Firm*—Nixon Peabody LLP

(57) ABSTRACT

A first switch (10) has a first pair of contacts (12, 14) that are mounted to move relative to each other in translation. A circuit-breaker second switch (20) has a second pair of contacts (21, 24) that are mounted to move relative to each other in translation, the second switch (20) being put in parallel with the first switch (10). A disconnector third switch (30) has a third pair of contacts (32, 34) that are mounted to move relative to each other. Synchronization means (50, 50') make it possible, while breaking is taking place, for the contacts of the first switch (10) to separate before the contacts of the second switch (20) separate, the contacts of the second switch themselves separating before the third contacts (32, 34) separate fully. The synchronization means are actuated by a servomotor (40).

12 Claims, 4 Drawing Sheets

ALTERNATOR DISCONNECTOR CIRCUIT-BREAKER BY A SERVOMOTOR

CROSS-REFERENCE TO RELATED PATENT APPLICATION OR PRIORITY CLAIM

This application claims the benefit of a French Patent Application No. 06-51709, filed on May 12, 2006, in the French Intellectual Property Office, the disclosure of which is incorporated herein in its entirety by reference.

BACKGROUND

Field of the Invention

The invention relates to an alternator disconnector circuit-breaker comprising:

- a first switch having a first pair of contacts that are mounted to move relative to each other in translation along a first axis;
- a circuit-breaker second switch having a second pair of contacts that are mounted to move relative to each other in translation along a second axis, the second switch being put in parallel with the first switch;
- a disconnector third switch having a third pair of contacts that are mounted to move relative to each other; and
- synchronization means making it possible, while breaking is taking place, for the contacts of the first switch to separate before the contacts of the second switch separate, the contacts of the second switch themselves separating before the third contacts separate fully;

Switchgear of this type is already known (EP 0 877 405, EP 0 878 817). Such switchgear is driven by a single control means connected to the pole by a linkage serving to guarantee that the circuit-breaker is driven in the proper operating sequence. However, a combined control means and a linkage capable of opening a main circuit, a circuit-breaker, and then a disconnector, and then of actuating a position indicator, is very difficult to design because of the contradiction between the requirements for the movements of each of the items of equipment and the time taken by the movements of conventional control means for controlling circuit-breakers. That actuating sequence is also made complex by the combination of geometrical and of time constraints.

It is also known (EP 1 108 261) that a servomotor can be used for actuating a circuit-breaker. However, such a servomotor is not used for driving a plurality of items of switchgear via a common linkage.

OVERVIEW

An object of the present invention is to provide an alternator disconnector circuit-breaker that remedies those drawbacks. This object is achieved by the fact that the synchronization means are actuated by a servomotor.

By means of this characteristic, it is possible to control the movement characteristics of the contacts as a function of time by an electronic method. This makes it possible to adjust the control energy to match exactly the needs of the movement to be achieved.

Advantageously, the servomotor actuates the synchronization means in a manner such as to obtain an opening speed at which the contacts of the first switch open that lies in the range 1.5 meters per second (m/s) to 2.5 m/s for about the first half of the opening stroke of said contacts and an opening speed at which said contacts open that lies in the range 0.5 m/s to 0.8 m/s for the second half of the opening stroke of said contacts.

By means of this characteristic, a fast movement is generated at the beginning of the cycle that slows down sharply in a portion of the cycle so as to wait for the arc to be extinguished and for the disconnector to move.

Preferably, the synchronization means are designed in a manner such that the second switch opens when the first switch has traveled along substantially one half of its stroke at an opening speed lying in the range 1.5 m/s to 2.5 m/s.

Preferably, the third switch opens once the first switch has traveled along substantially two-thirds of its opening stroke. Advantageously, the synchronization means are designed in a manner such that the opening speed of the third switch lies in the range 1.5 m/s to 2.5 m/s.

Optional or alternative additional characteristics are listed below:

- the contacts of the third pair of the third switch are mounted to move relative to each other in translation along a third axis, at least one of the second and third axes intersecting the first axis;
- the third axis is substantially parallel to the first axis;
- the second axis intersects the first axis;
- the contacts of the third pair are mounted to move relative to each other by pivoting about an axis;
- the third switch is in series with the second switch and the second and third switches together are in parallel with the first switch;
- the second axis forms an angle that is substantially equal to 90° relative to the first axis;
- each pair of contacts is associated with an actuator bar that is mounted to move under action from control means; and
- the circuit-breaker has synchronization means adapted to separate the contacts of the first switch, then the contacts of the second switch, and then the contacts of the third switch, in that order.

BRIEF DESCRIPTION OF DRAWINGS

Other characteristics and advantages of the present invention will also appear on reading the following description of embodiments given by way of illustration and with reference to the accompanying drawings. In the drawings.

DESCRIPTION OF EXAMPLE EMBODIMENTS

Figure 1:
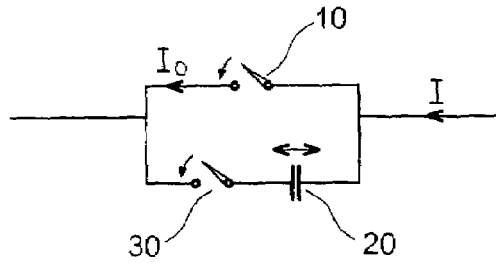
FIG. 1 diagrammatically shows the circuit-breaking principle of a disconnector circuit-breaker of the invention.

The operating principle of a circuit-breaker, and in particular of an alternator circuit-breaker of the invention, is shown diagrammatically in FIG. 1, with a main circuit in which a current $I_0$ close to the rated current I flows when in operation, and an auxiliary circuit that is used for breaking a short-circuit.

For an alternator circuit-breaker, passing a current I of rated magnitude greater than a few thousand amps requires a switch 10 whose contacts are particularly conductive, e.g. made of copper, to be used on the main circuit; the breaking power of those contacts is, however, limited due to electric arcs striking. A circuit-breaker second switch 20 is put in parallel with the first switch 10 in order to perform the circuit-breaking function proper. The first switch 10 opening causes, de facto, the current I to be switched over from the main circuit to the auxiliary circuit; the contacts of said second switch 20 that are, for example, made of tungsten, are of limited performance as regards passing the rated current I, but have high breaking power.

Thus, the functions of passing the permanent current and of breaking short-circuit current are separated: when such circuit-breaking is necessary, firstly the first switch 10 is activated, all of the current I then going over to the auxiliary circuit and causing the second switch 20 to be opened so as to obtain the circuit-breaking function. In addition, a third switch 30 is then opened: its function is mainly a safety function, its association on the auxiliary circuit making it possible to avoid a reduction in the dielectric strength of the second switch 20 that might accidentally allow current to pass into the associated branch.

In order to re-close such a circuit-breaker, the reverse order applies: firstly the disconnector 30 is re-closed, then the circuit-breaker switch 20 is re-closed, and finally the first switch 10 is re-closed.

Each of the switches 10, 20, 30 has a pair of contacts that are mounted to move relative to each other; advantageously, the first contact 12, 22, 32 of each pair is stationary, and the second contact 14, 24, 34 is a moving contact that is mounted to move relative to the first contact. In a first embodiment show in FIG. 2, each of the moving contacts moves in translation along a respective axis AA, BB, CC.

In particular, the first switch 10 can be of the gas-insulated type; it can also, if the rated current is very high, itself be an item of switchgear comprising two switches put in parallel with each other. Preferably, however, as shown, the first switch 10 is an air-insulated switch having a tubular first contact 12 into which a second contact 14 that is also tubular can be inserted.

The second switch 20 can be a gas-insulated circuit-breaker containing a gas of the sulfur hexafluoride ($SF_6$) type; preferably, since the current $I-I_0$ passing through it is low under normal operating conditions, it is a vacuum "bottle": this reduces costs and makes it possible to avoid using $SF_6$, which does not satisfy all ecological criteria. The moving contact 24 of the second switch 20 is moved by means of an actuator bar 44 mounted to move along the axis BB.

Finally, the third switch 30 can, in one embodiment, have a stationary contact 32 into which another moving contact 34 of the rod type can be inserted along the opening/closure axis CC. The rod 34 can be moved via a bar 46 in translation.

A servomotor 40 makes it possible to move the first, second, and third moving contacts 14, 24, and 34. To this end, the servomotor 40 is connected functionally to each of the actuators 42, 44, 46. Synchronization means 50 make it possible to defer the relative openings of the switches 10, 20, 30.

The servomotor 40 opens the first switch 10 first. This opening takes place, in a first portion of the opening stroke of the contacts at a relatively high speed, lying in the range 1.5 m/s to 2.5 m/s, and preferably equal to 2 m/s. The first portion extends over substantially one half of the opening stroke of the first switch 10.

Once the first switch has reached a sufficient opening distance, the synchronization means 50 cause the second switch 20 to open. Said sufficient distance is a function of voltage. By way of example, an opening distance of 70 millimeters (mm) can be sufficient for a voltage of 61 kilovolts (kV). In any event, the second switch opens at the latest once the first switch has traveled along one half of its stroke. For example, if the stroke of the first switch is 170 mm, the second switch opens at the latest once the moving contacts of the first switch have traveled 85 mm. Its opening speed is relatively fast, and is about 2 m/s.

Once the first switch has traveled along one half of its stroke, the servomotor slows down its speed of actuation of the synchronization mechanism 50 so that the second half of the opening of the contacts 12, 14 takes place relatively slowly. The expression "relatively slowly" should be understood to mean that the opening speed, expressed in m/s is about three times slower than the relatively fast speed. Thus, the relatively slow opening speed of the first switch lies in the range 0.5 m/s to 0.8 m/s.

Once the circuit-breaker 20 is open, the synchronization means act to guarantee that a certain waiting time necessary for extinguishing the arc of the circuit-breaker 20 elapses before the third contact 34 of the disconnector 30 is moved. Once the disconnector has reached a sufficient disconnection distance, the servomotor moves a position indicator (not shown) whose function is to indicate whether the circuit-breaker is open or closed.

Although each actuator bar 42, 44, 46 of this embodiment moves in translation and is secured to the same control means 40, the three opening/closure axes AA, BB, CC are not necessarily parallel, at least one of them intersecting the first axis AA, for example. For reasons of compactness, it is preferable to dispose at least one axis BB at an angle of about 90° relative to the first axis AA. Although this configuration requires different arrangements of the pairs of contacts 12, 14; 22, 24; 32, 34 and of the means 42, 44, 46 for moving them, it appears that this configuration, which is a priori dismissed for reasons of complexity of the synchronization, can be chosen.

For example, the synchronization means 50 can thus comprise a groove 52 in the actuator bar 42 of the first switch 10, which groove is generally longitudinal along the axis AA of the bar but has a slanting portion, the groove being associated with an element of the lug 54 type integral with the second actuator bar 44, so that, in a first stage, while the first moving contact 14 is moving, the position of the lug 54 is moved so as to move the second moving contact 24 away from the second stationary contact 22.

Figure 2:
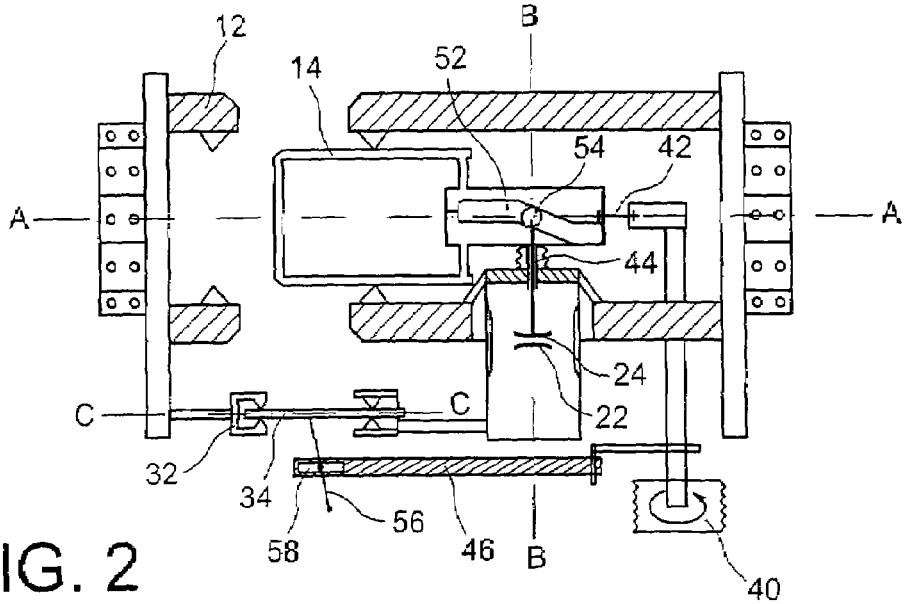
FIG. 2 shows a preferred embodiment of the circuit-breaker of the invention.

It can be advantageous for the axes AA, CC of the change-over switch 10 and of the disconnector 30 to be parallel, as shown in FIG. 2, but other options are possible, as described below. The synchronization means 50 can have a system similar to the preceding system 52, 54 for deferring opening of the disconnector 30 relative to opening of the circuit-breaker switch 20; it is however preferable for the synchronization means 50 to be associated directly between the first and the third switches 10, 30. For example, the synchronization means 50 comprise a lever arm 56 coupled at an end portion to the third moving contact 34 and whose pivot axis is associated with a groove 58 located in the actuator bar 46 of the third switch 30: the actuator bars 42, 46 of the first and third switches 10, 30 are moved jointly by the actuator means 40, but a delay in moving the third contact 34 is generated by the latency before the lever 56 pivots.

Other actuation and synchronization solutions are naturally imaginable.

In particular, as shown in FIG. 3, the disconnector switch 30' can operate on another principle of the "knife-switch" type. In the alternator circuit-breaker shown, the main switch 10' has two contacts 12', 14' that are mounted to move relative to each other in translation, and that are disposed in a casing such as a tube that is 200 mm in diameter; in an operating position shown in FIG. 3A, the alternator current $I_0$ flows through this main circuit (see arrow).

When circuit-breaking is required, the servomotor 60 separates two contacts 12', 14' relatively rapidly: actuation is effected by means of a bar 42'. In a first stage shown in FIG. 3B, the current I continues to flow along its main path, but an arc strikes across the distance between the two contacts 12', 14' of the switch 10'; then the circuit-breaking on the main circuit is completed (FIG. 3C), and the current flows through the auxiliary circuit only, the delay means 50' having deferred opening of the contacts 22', 24' of the circuit-breaker switch 20'. For example, the dielectric distance on the main circuit makes it possible to withstand the transient re-strike voltage, i.e. the actuator bar 42' moves over about one half of its total stroke before the vacuum chamber 20' opens.

Figure 3A:
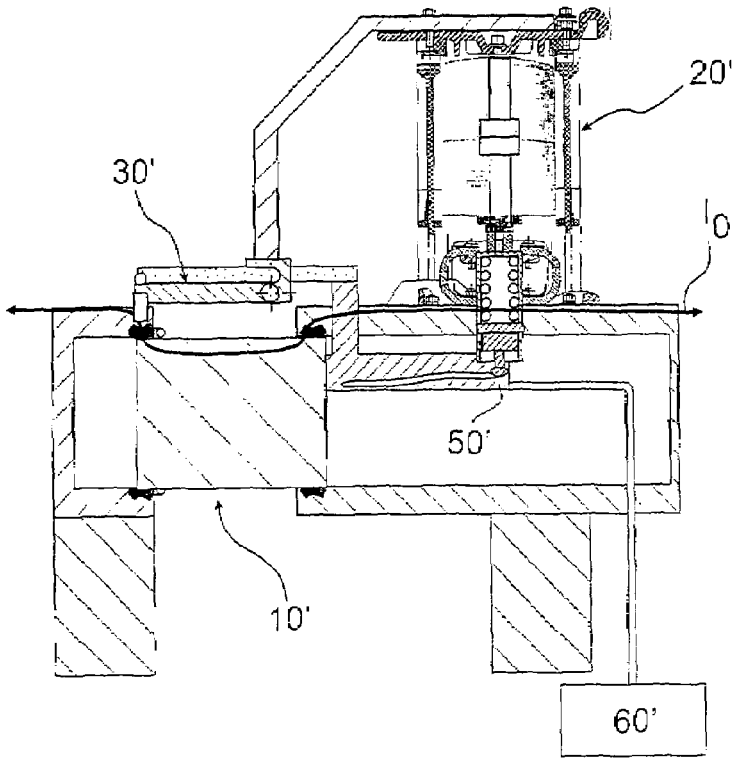
FIGS. 3A to 3F show a circuit-breaking sequence for another embodiment of an alternator circuit-breaker of the invention.
Figure 3B:
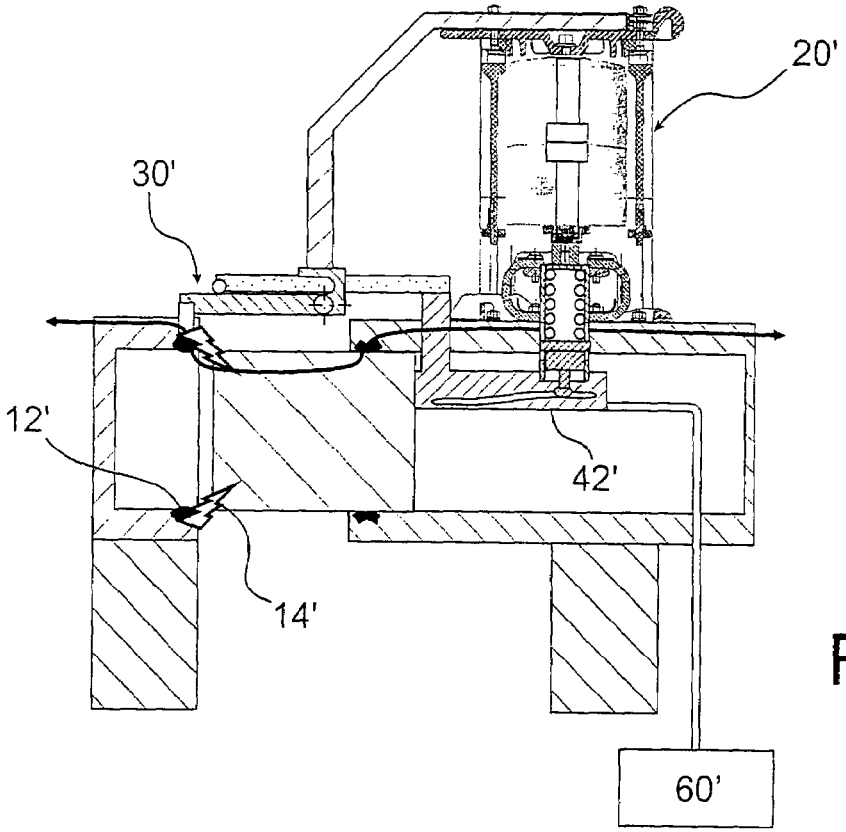
Figure 3C:
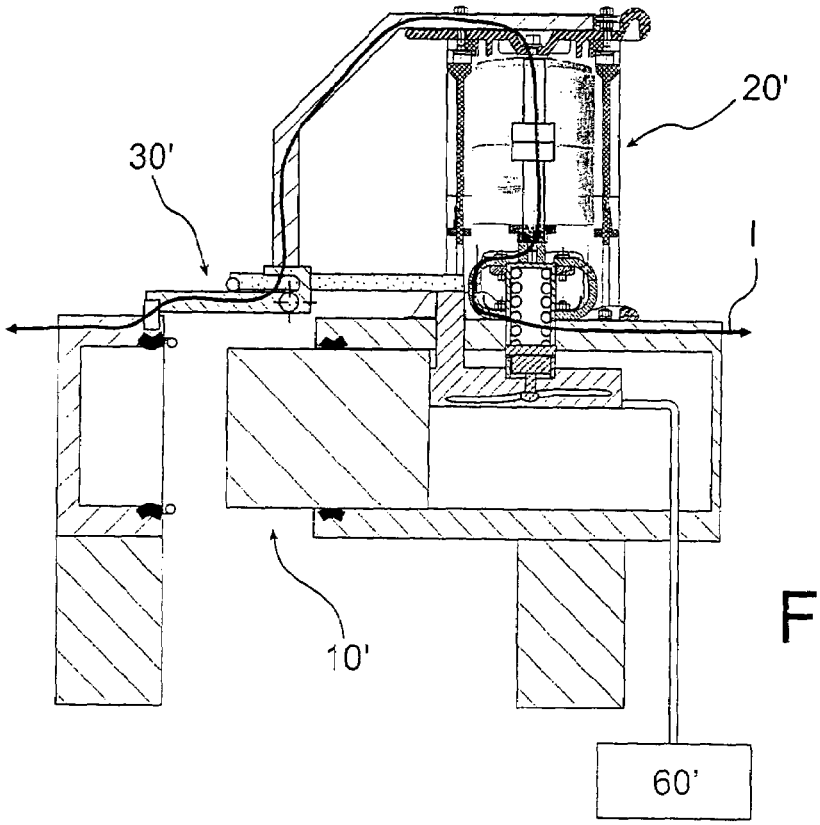
Figure 3D:
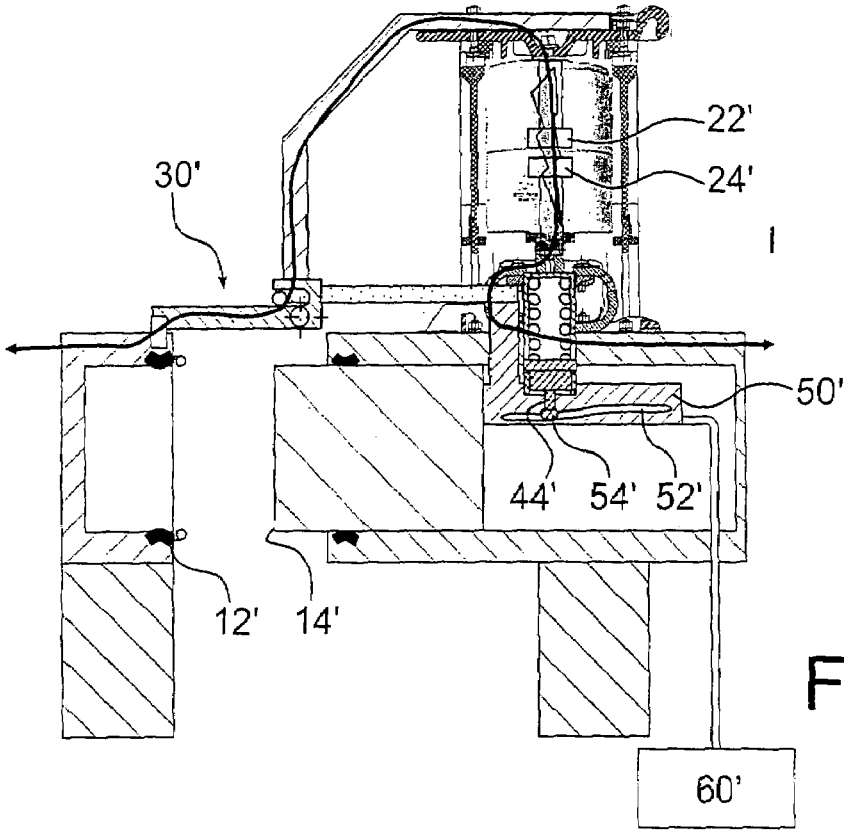
Figure 3E:
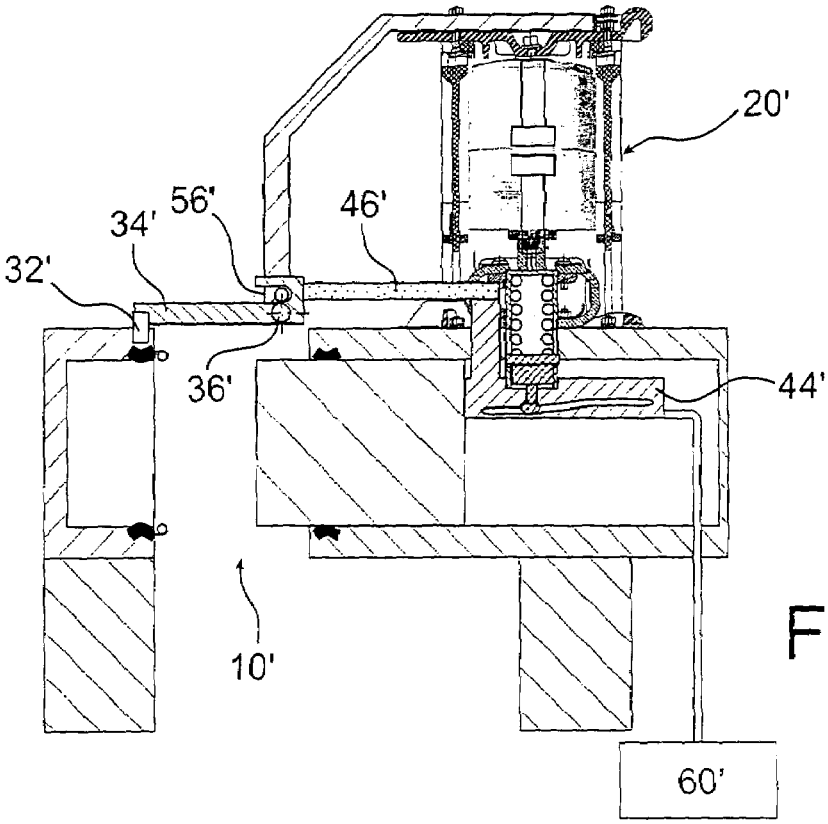

In order to break the short-circuit current, the servomotor 60' moves in translation the two relatively movable contacts 22', 24' of the circuit-breaking chamber 20' along an axis orthogonal to the translation axis of the first switch 10': FIG. 3D. The two contacts 22', 24' are moved by means of an actuator bar 44' that is orthogonal to the bar 42', and that is secured thereto via delay means 50', e.g. by means of a lug 54' moving in a groove 52' in the first actuator bar 42'. While the contacts 22', 24' are moving apart, an arc strikes, and then, very rapidly, circuit-breaking is completed: FIG. 3E.

Figure 3F:
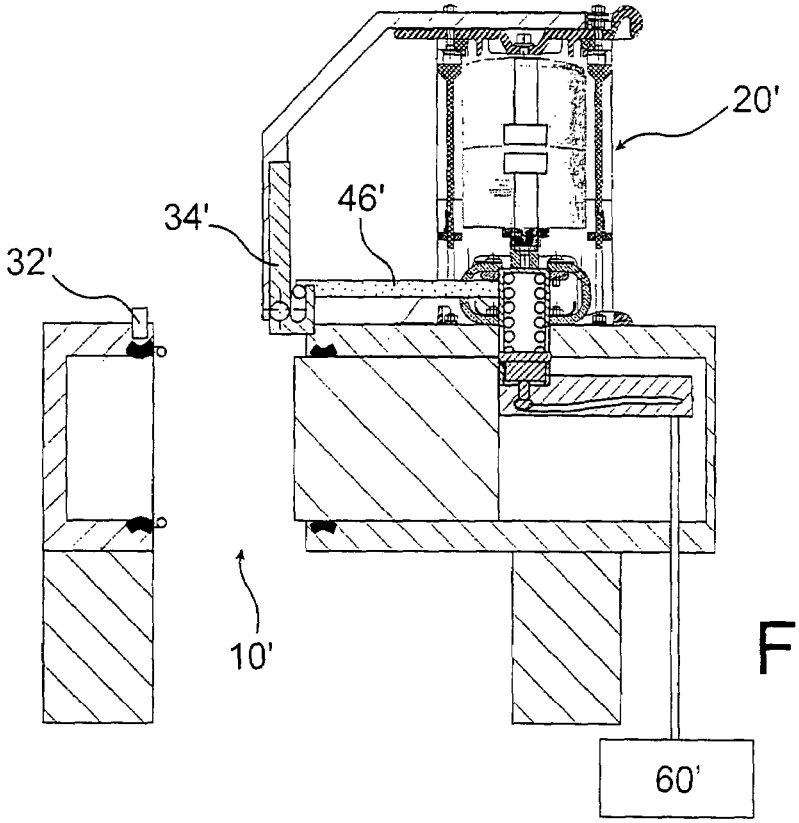

During these stages, and by means of the delay means 50', the disconnector switch 30' is not actuated. From this point, the servomotor 60' drives the contacts relatively slowly. The stationary contact 32' of the disconnector 30' is secured to the stationary contact 12' of the first switch; the second contact 34' of the disconnector 30' is mounted to move relative to the stationary contact by pivoting about an axis 36'. The actuator means 46' for actuating the contacts 32', 34' of said switch 30' are secured to the first bar 42'; in addition, at the pivot 36', the moving contact 34' is provided with delay means 56' in the form of a groove that is complementary to a lug on the actuating bar 46', but that enables the lug to move relative thereto before the contact 34' is driven by the bar 46' in rotation about its axis 36'; finally, as shown in FIG. 3F, the disconnection is completed.

Naturally, other actuations are possible: for example, the disconnector 30' can also move in a "horizontal" plane, i.e. in the context shown, by pivoting about an axis 36' that is parallel to one of the translation axes of the contacts of the other two switches 10', 20'.

Figure 4:
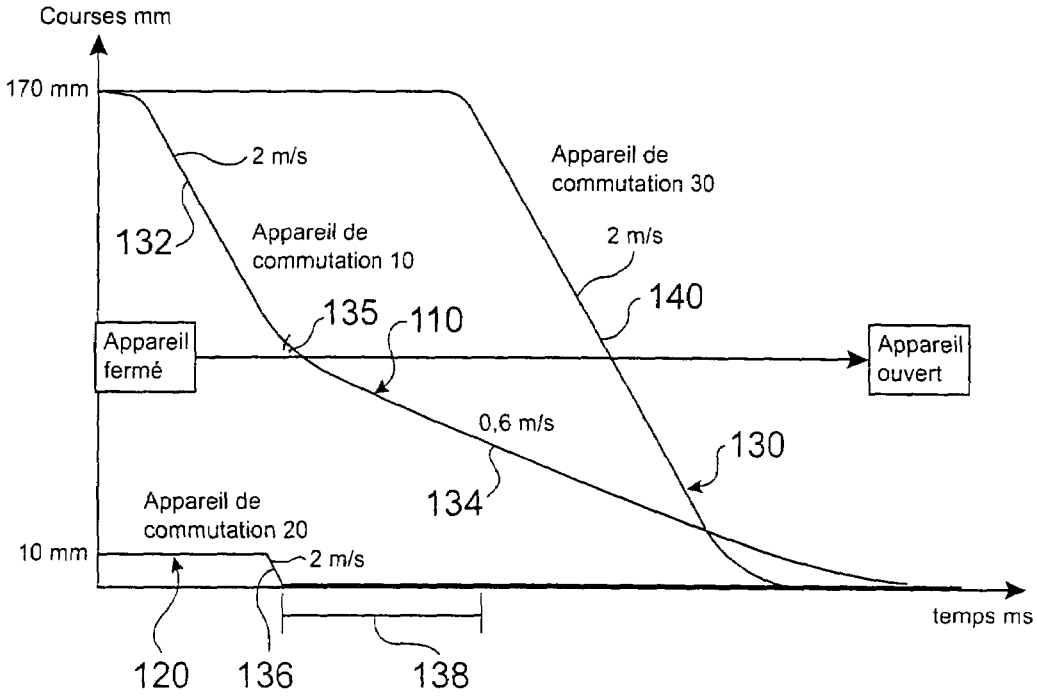
FIG. 4 shows three curves that represent the strokes of the three switches as a function of time.

In FIG. 4, reference 110 identifies the curve of the opening stroke of the first contact 10, reference 120 identifies the opening stroke of the second switch 20, and reference 130 identifies the opening curve of the third switch 30. As can be observed, curve 110 presents a portion 132 of steep gradient, and a portion 134 of relatively shallower gradient. Portion 132 corresponds to that portion of the cycle during which the servomotor 40 or 60' actuates the synchronization means relatively rapidly, and the portion 134 corresponds to the second portion of the opening cycle of the disconnector circuit-breaker during which portion the servomotor actuates the same synchronization means relatively slowly. By way of example, the portion 132 of the curve 110 corresponds to an opening speed of 2 m/s, whereas the portion 134 of the same curve corresponds to an opening speed of 0.6 m/s. In other words, the opening speed is more than three times higher during the relatively fast portion of the opening cycle than during the relatively slow opening portion. The point 135 of transition between the two portions of the curve is situated substantially half way along the opening stroke of the first switch 10. As can be seen in FIG. 4, the circuit-breaker switch 20 opens substantially at the end of the fast opening period and the gradient of the portion 136 is substantially equal to the gradient of the portion 132, i.e. it corresponds to a speed of approximately 2 m/s, in the example. After the end of the opening of the circuit-breaker switch 20, a certain waiting time elapses, e.g. about ten milliseconds (ms) as shown by the straight-line segment 138 before the disconnector third switch 30 opens. At this point, the first switch has traveled along substantially two-thirds of its opening stroke. The disconnector switch 30 then opens relatively rapidly, as shown by the gradient 140 of the curve 120, i.e. at a speed of about 2 m/s, even though, at that time, the servomotor is actuating opening of the first contact relatively slowly. The relatively fast opening of the third switch is obtained by the construction of the synchronization means, e.g. by the ratio of the lever arms 42 and 56 (see FIG. 2).

What is claimed is:

1. An alternator disconnector circuit-breaker comprising:

a first switch having a first pair of contacts that are mounted to move relative to each other in translation along a first axis;

a circuit-breaker second switch having a second pair of contacts that are mounted to move relative to each other in translation along a second axis, the second switch electrically connected in parallel with the first switch;

a disconnector third switch having a third pair of contacts that are mounted to move relative to each other; and synchronization means making contacts of the first switch to separate before the contacts of the second switch separate, wherein the contacts of the second switch separate before the third contacts separate fully;

said alternator disconnector circuit-breaker being characterized in that the synchronization means are actuated by a servomotor which actuates the synchronization means to obtain a first opening speed at which the first pair of contacts begin to separate around a first half of an opening stroke, the servomotor and the synchronization means to obtain a second opening speed at which the first pair of contacts continue to open around a second half of the opening stroke, wherein the first opening speed is approximately three times greater than the second opening speed.

2. A circuit-breaker according to claim 1, characterized in that the servomotor actuates the synchronization means in a manner such as to obtain an opening speed at which the contacts of the first switch open that lies in the range 1.5 m/s to 2.5 m/s for about the first half of the opening stroke of said contacts and an opening speed at which said contacts open that lies in the range 0.5 m/s to 0.8 m/s for the second half of the opening stroke of said contacts.

3. A circuit-breaker according to claim 2, characterized in that the synchronization means are designed in a manner such that the second switch opens when the first switch has traveled along substantially one half of its stroke at an opening speed lying in the range 1.5 m/s to 2.5 m/s.

4. A circuit-breaker according to claim 2, characterized in that the third switch opens once the first switch has traveled along substantially two-thirds of its opening stroke.

5. A circuit-breaker according to claim 4, characterized in that the synchronization means are designed in a manner such that the opening speed of the third switch lies in the range 1.5 m/s to 2.5 m/s.

6. A circuit-breaker according to claim 1, characterized in that the contacts of the third pair of the third switch are mounted to move relative to each other in translation along a third axis, at least one of the second and third axes intersecting the first axis.

7. A circuit-breaker according to claim 6, in which the third axis is substantially parallel to the first axis.

8. A circuit-breaker according to claim 1, characterized in that the contacts of the third switch are mounted to move relative to each other by pivoting about an axis.

9. A circuit-breaker according to claim 1, characterized in that the third switch is in series with the second switch and the second and third switches together are in parallel with the first switch.

10. A circuit-breaker according to claim 1, characterized in that the second axis forms an angle that is substantially equal to 90° relative to the first axis.

11. A circuit-breaker according to claim 1, characterized in that each pair of contacts is associated with an actuator bar that is mounted to move under action from control means.

12. A circuit-breaker according to claim 1, characterized in that the synchronization means are adapted to re-close the contacts of the switches successively in the reverse order relative to the order in which they are separated.

* * * * *